United States Patent [19]

Lamping et al.

[11] Patent Number: 4,673,601

[45] Date of Patent: Jun. 16, 1987

[54] COLD- OR HEAT-SEALABLE COMPOSITE FILM FOR RECLOSABLE PACKAGES

[75] Inventors: Alfons Lamping, Corminboeuf; Beat Karth, Oberönz; Werner Hiltbrunner, Bern, all of Switzerland

[73] Assignee: Nyffeler, Corti AG, Switzerland

[21] Appl. No.: 730,942

[22] Filed: May 6, 1985

[30] Foreign Application Priority Data

May 7, 1984 [DE] Fed. Rep. of Germany ..... 3416755

[51] Int. Cl.[4] ..... B32N 5/02

[52] U.S. Cl. ..... 428/35; 428/40; 428/349; 428/354; 428/476.9; 428/511; 428/514; 428/517; 428/518; 428/519; 428/522; 428/523; 220/258; 206/631

[58] Field of Search ..... 428/349, 40, 522, 523, 428/35; 220/258

[56] References Cited

U.S. PATENT DOCUMENTS

| | | | |
|---|---|---|---|
| 3,854,653 | 12/1974 | Engelsberger | 229/51 R |
| 4,055,672 | 10/1977 | Hirsch et al. | 426/127 |
| 4,101,047 | 7/1978 | Geppert et al. | 220/258 |
| 4,279,344 | 7/1981 | Holloway | 206/631 |
| 4,521,467 | 6/1985 | Berger | 428/41 |

*Primary Examiner*—Edith Buffalow

*Attorney, Agent, or Firm*—Birch, Stewart, Kolasch & Birch

[57] ABSTRACT

A cold- or heat-sealable composite film comprises a permanently adhesive layer which is applied to a carrier film and which, on the side facing away from the carrier film, has a covering layer of a material having a low elongation at break and low tear propagation strengths. If the covering layer is not itself cold- or heat-sealable, it is provided with an appropriate cold- or hot-sealing layer. The composite film can be used as a closing membrane for preformed containers or can itself be formed as a container.

12 Claims, 3 Drawing Figures

FIG. 1
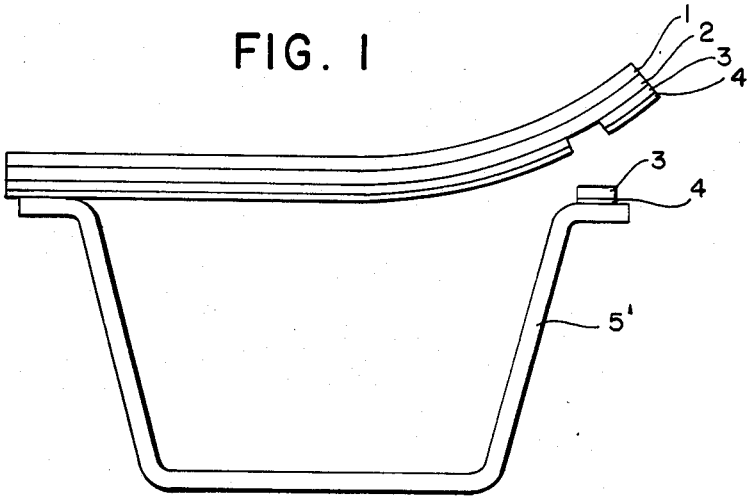
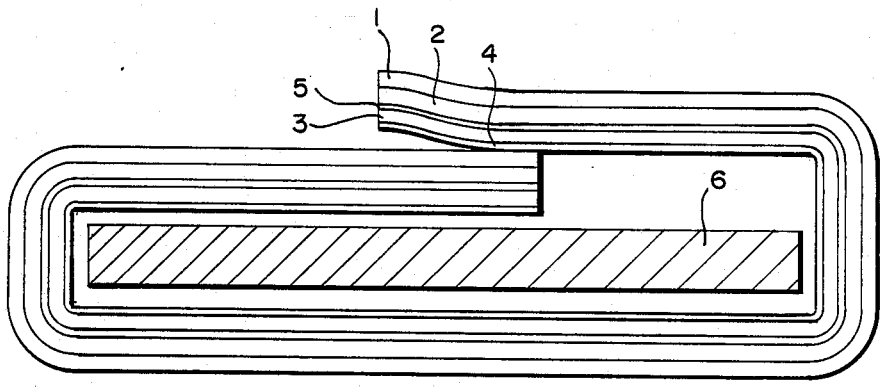
FIG. 2a
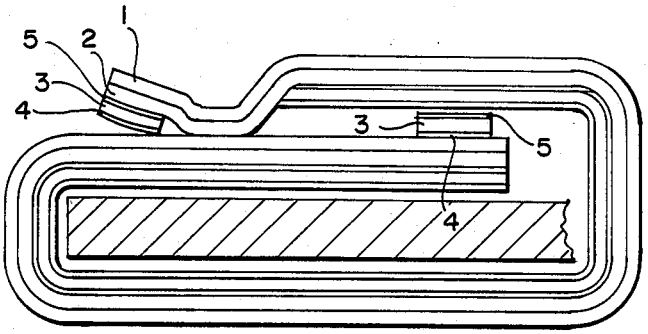
FIG. 2b

COLD- OR HEAT-SEALABLE COMPOSITE FILM FOR RECLOSABLE PACKAGES

The present invention relates to a cold- or heat-sealable composite film for reclosable packages, which film can be used either as a closing membrane for preformed containers or can itself be used for forming containers and which, on cold- or heat-sealing, gives hermetically sealed closures which can be manually reclosed after they have been opened for the first time.

Cold- or heat-sealable composite films which are used as closing membranes for containers or can themselves be formed as containers, have already been disclosed. Conventional composite films of this type, however, have the disadvantage that packages produced from them can either not be reclosed at all after opening, or at least not by simple manual rejoining. To a certain extent, cold-sealable films can be closed manually, but only when a relatively high pressure is applied and two surfaces with a cold-sealable coating are pressed together. Cold-sealing coatings have the additional disadvantage that they are slightly tacky and can not therefore be brought into contact with any desired charge product, for example with dusty products.

It is therefore the object of the present invention to provide a cold- or heat-sealable composite film for reclosable packages which, after the cold- or heat-sealed connection has been opened for the first time, can be reclosed once or several times without a particular application of force by simple pressing the opened part to any desired point of the composite film or to a suitable surface of another article, for example the rim of the open container.

The subject of the present invention is a cold- or heat-sealable composite film for reclosable packages, which comprises a permanently adhesive layer which is applied to a carrier film and which, on the side facing away from the carrier film, has a covering layer of a material having a lower elongation at break and lower tear propagation strength. This material can itself be cold- or heat-sealable, so that a separate sealing layer is not necessary. Otherwise, a cold- or heat-sealing layer of conventional cold- or heat-sealing media is applied to the covering layer.

The present invention is explained in more detail below by means of the preferred embodiments, with reference to the drawing in which:

FIG. 1 shows a diagrammatic cross-section through a composite film according to the present invention, in the form of a closing membrane on a preformed container, in a partially opened state;

FIG. 2*a* shows a diagrammatic cross-section through a composite film according to the present invention, which is itself used for packaging an article; and FIG. 2*b* shows a diagrammatic cross-section through the packaging of FIG. 2*a*, after this packaging has been opened and reclosed.

The composite film shown in FIG. 1 consists of a carrier film 1, a permanently adhesive layer 2, a covering layer 3 and a sealing layer 4.

Examples of suitable materials for the carrier film 1 are a polyester, such as polyethylene terephthalate, a polyamide, biaxially oriented polypropylene, regenerated cellulose, polyvinyl chloride, metals, such as aluminum, and paper.

The permanently adhesive layer 2 consists, for example, of hot-melt adhesives, for example, ethylene/vinyl acetate copolymers, styrene/butadiene/styrene/block copolymers, styrene/isoprene/styrene/block copolymers or polyacrylates, or other suitable pressure-sensitive adhesives.

The covering layer 3 consists of a material of low elongation at break and low tear propagation strength, in a suitable layer thickness. Preferred materials of this type are polyethylene, polypropylene, polyamide, polyvinyl chloride, hot melts, such as ethylene/vinyl acetate copolymers, regenerated cellulose and metals, such as aluminum.

If the material of the covering layer 3 is itself sealable, as is the case with polyethylenes, a separate sealing layer is unnecessary. Otherwise, a sealing layer 4 of conventional cold- or heat-sealing media is applied to the covering layer.

If a composite film of the type shown in FIG. 1 is sealed as a closing membrane to the opening of a preformed container 5', for example a jar, and is later wholly or partially separated from the container rim by means of a tear-off tab, the covering layer 3 tears at the start of the opening procedure. As tearing-open of the sealing seam continues, the covering layer 3 in the region of the sealing seam remains, due to its low tear propagation strength, on the container rim. As a result, the permanently adhesive layer 2 is exposed. For reclosing the container, it is only necessary to place the seam surfaces back onto one another and to press them lightly against one another.

In the embodiment shown in FIGS. 2*a* and 2*b*, the composite film itself is used as the packaging material for an article 6. The packaging is shown in the unopened state in FIG. 2*a*, and in the opened and reclosed state in FIG. 2*b*.

In this embodiment, the composite film again comprises a carrier film 1, a permanently adhesive layer 2, a covering layer 3 of a material of low elongation at break and low tear propagation strength, and if appropriate a sealing layer 4. The same materials as in the embodiment of FIG. 1 can be used for the individual layers.

In FIG. 2, a part of the packaged article, for example chocolate, has already been taken out, and the folding closure has been reclosed at another point. In this case, it is an advantage to provide the covering layer 3 with an adhesive layer 5 on the side facing away from the permanently adhesive layer 2, in order to avoid a break in cohesion of the layer 2 and to obtain a non-stick side of the seam which has been torn open. Silicones are an example of adhesive materials suitable for the layer 5.

In all the embodiments described above and particularly in applications where the composite film must withstand relatively high mechanical stresses, predetermined breaking points in the form of weakened lines can be produced in the covering layer along the desired tearing line, for example by means of suitable sealing tools. This ensures in addition that the tearing force of the covering layer is lower than the cohesive force of the sealing seam.

The carrier film of the composite film according to the present invention is available for decorative purposes and can, for example, be printed. This makes it possible to use the composite film, peeled off from the opened package, for other purposes due to its self-adhesive properties, for example to stick it onto different substrates.

What is claimed is:

1. A cold- or heat-sealable composite film for sealing and resealing reclosable packages or containers which comprises:

a carrier film, a permanently adhesive layer and a covering layer, said permanently adhesive layer being disposed between said carrier film and said covering layer, said covering layer being made of a material having an elongation at break and a tearing strength which is lower than the cohesive strength between the composite film and the sealing bond with the package or container.

2. The cold- or heat-sealable composite film of claim 1 wherein the covering layer has an elongation at break and a tearing strength which is lower than the combination of the carrier film and permanent adhesive layer, whereby when the composite film is lifted from the container so as to open it, the covering layer will tear, exposing the permanently adhesive layer which is then available for resealing.

3. The cold- or heat-sealable composite film of claim 1 wherein the permanently adhesive layer is selected from the group consisting of ethylene/vinyl acetate copolymers, styrene/butadiene/styrene block copolymers, styrene/isoprene/styrene block copolymers and polyacrylates.

4. The cold- or heat-sealable composite film of claim 2 wherein an adhesive layer is provided between the cover layer and the permanently adhesive layer.

5. The composite film as claimed in claim 1, wherein a cold- or heat-sealable layer is applied to the covering layer.

6. The composite film as claimed in claim 1, which has an adhesive layer between the permanently adhesive layer and the covering layer.

7. The composite film as claimed in claim 1, wherein the carrier film is selected from the group consisting of a polyester, a polyamide, polyvinyl chloride, biaxially oriented polypropylene, regenerated cellulose, aluminum and paper.

8. The composite film as claimed in claim 1, wherein the permanently adhesive layer consists of a pressure-sensitive adhesive.

9. The composite film as claimed in claim 1, wherein the covering layer is selected from the group consisting of polyethylene, polypropylene, a polyamide, polyvinyl chloride, hot melts, regenerated cellulose and aluminum.

10. The composite film as claimed in claim 1, which is in the form of a closing membrane for preformed containers.

11. The composite film as claimed in claim 1, which is itself formed as a container.

12. The composite film as claimed in claim 1, wherein the covering layer has, along an anticipated tearing line, predetermined breaking points in the form of weakened lines.

* * * * *